US005299493A

United States Patent [19]

Durbin et al.

[11] Patent Number: 5,299,493

[45] Date of Patent: Apr. 5, 1994

[54] SYSTEM FOR MONITORING TRASH COMPACTORS

[75] Inventors: Martin J. Durbin, Oak Forest; Morris Simon, Northbrook, both of Ill.

[73] Assignee: One Plus Corp., Northbrook, Ill.

[21] Appl. No.: 959,709

[22] Filed: Oct. 13, 1992

[51] Int. Cl.[5] ..... B30B 15/16

[52] U.S. Cl. ..... 100/50; 100/53; 100/99; 100/193; 100/229 A; 100/269 R

[58] Field of Search ..... 100/48, 50, 53, 193, 100/209, 229 A, 99, 269 R

[56] References Cited

U.S. PATENT DOCUMENTS

| | | | |
|---|---|---|---|
| 3,250,414 | 5/1966 | Pioch | 100/229 A X |
| 3,336,861 | 8/1967 | Clar | 100/50 X |
| 3,384,007 | 5/1968 | Boje et al. | 100/50 X |
| 3,534,678 | 10/1970 | Clar | 100/50 |
| 3,636,863 | 1/1972 | Woyden | 100/53 X |
| 3,695,175 | 10/1972 | Bausenbach et al. | 100/193 |
| 3,765,147 | 10/1973 | Ippolito et al. | 100/229 A X |
| 3,802,335 | 4/1974 | Longo | 100/50 X |
| 3,822,638 | 7/1974 | Merkin | 100/99 X |
| 3,872,784 | 3/1975 | Kaszuba et al. | 100/50 X |
| 3,918,359 | 11/1975 | Hennells et al. | 100/99 X |
| 4,044,664 | 8/1977 | Budoff | 100/48 |
| 4,116,050 | 9/1978 | Tanahashi et al. | 100/99 X |
| 4,195,563 | 4/1980 | Budraitis et al. | 100/50 X |
| 4,274,282 | 6/1981 | Budraitis et al. | 100/99 X |
| 4,603,625 | 8/1986 | Brown | 100/53 |
| 4,643,087 | 2/1987 | Fenner et al. | 100/50 X |
| 4,773,027 | 9/1988 | Neumann | 100/50 X |
| 4,787,308 | 11/1988 | Newsom et al. | 100/50 |
| 4,953,109 | 8/1990 | Burgis | 100/50 X |
| 5,016,197 | 5/1991 | Neumann et al. | 100/50 X |
| 5,173,866 | 12/1992 | Neumann et al. | 100/50 X |
| 5,214,594 | 5/1993 | Tyler et al. | 100/229 A X |

FOREIGN PATENT DOCUMENTS

| | | | |
|---|---|---|---|
| 2902360 | 7/1980 | Fed. Rep. of Germany | 100/99 |
| 83/04192 | 12/1983 | PCT Int'l Appl. | 100/99 |
| 593574 | 10/1947 | United Kingdom . | |

OTHER PUBLICATIONS

Petro Vend, "Compact Count 400", Installation/Owners Manual, 19 pages, 1986.

Waste Management, Inc., "Computerized Waste Flow Control" brochure, 6 pages, 1985.

*Primary Examiner*—Stephen F. Gerrity

*Attorney, Agent, or Firm*—Dressler, Goldsmith, Shore, Sutker & Milnamow, Ltd.

[57] ABSTRACT

In a system for monitoring trash compactors, each monitoring unit associated with a trash compactor comprises a transducer for sensing hydraulic pressure, for generating an analog signal from the sensed pressure, and for converting the analog signal to a frequency signal, and a microprocessor. The microprocessor compares pressure signal values generated from the frequency signal over timed intervals to a specified value indicative of a compaction. The microprocessor also compares the maximum pressure signal value generated therefrom, under certain conditions, to a threshold value indicative of the trash compactor having a substantially empty compactor and to a threshold value indicative of the trash compactor having a substantially full container. Whenever a specified, plural number of substantially empty compactions have been determined and whenever a specified, plural number of substantially full compactions have been determined, status signals are transmitted by the system to a central computer, via a modem.

15 Claims, 3 Drawing Sheets

SYSTEM FOR MONITORING TRASH COMPACTORS

TECHNICAL FIELD OF THE INVENTION

This invention pertains to a system for monitoring, from a computer at a remote, central location, a plurality of trash compactors of a type comprising a trash container, a ram operative in compacting strokes for compacting trash within the container, and means for applying force to advance and retract the ram. In the system, fullness of the container of each trash compactor is determined from a series of signals having values representative of the sensed force at successive times during a compacting stroke, by comparing the maximum value to a threshold value.

BACKGROUND OF THE INVENTION

In shopping malls, office buildings, apartment buildings, and other properties having multiple occupants, it is common to provide a plurality of trash compactors of a type comprising a trash container, a hydraulic ram operative in compacting strokes for compacting trash within the container, and a hydraulic pump operative for advancing and retracting the ram in such manner that hydraulic pressure is capable of being sensed between the pump and the ram. Frequently, arrangements are made for a hauler to empty the containers of specific ones of the trash compactors on a periodic basis, or whenever the hauler is contacted by a manager. Commonly, the hauler charges similar hauling fees whether the containers are filled partially or completely. There is a need, therefore, for managers of such properties to receive current information concerning which of the trash compactors require and do not require emptying.

As exemplified in Clar U.S. Pat. No. 3,336,861, Clar U.S. Pat. No. 3,534,678, Woyden U.S. Pat. No. 3,636,863, and Brown U.S. Pat. No. 4,603,625, it is known to provide a trash compactor with pressure-sensing or other means for determining when the container of the trash compactor is full. The Woyden patent discloses an arrangement of such means wherein telephone lines are used to send an alarm signal to a central office when an abnormal condition is sensed. Various systems have been disclosed for monitoring a plurality of trash compactors of the type noted above from a central location.

An early example of such a system is disclosed in Budoff U.S. Pat. No. 4,044,664. In that system, each trash compactor has a detector including a pressure switch for detecting increased pressure in the hydraulic fluid driving a hydraulic ran in such trash compactor when the container of such trash compactor has become packed. Moreover, when the container of a trash compactor becomes packed, a station selector at a central location deactivates the trash container and activates a trash compactor having an empty container.

Another such system sold and used heretofore includes compactor controllers manufactured by Petro-Vend, Inc., for Waste Management, Inc. In that system, a compactor controller including a microprocessor at each trash compactor is arranged for limiting access to authorized users, for monitoring usage of such trash compactor by each authorized user and by all authorized users, for recording data concerning such usage, and for transmitting data concerning such usage to a computer at a central location, via a modem and telephone connections.

Various embodiments of such a system are disclosed in NeurAann et al. U.S. Pat. No. 5,016,197. In each embodiment, a sensing unit associated with each trash compactor transmits data to a computer at a central location, via telephone lines. The computer determines fullness of each trash compactor from the transmitted data. In one embodiment, the transmitted data include data relating to instantaneous pressures and to actuation of a limit switch. In another embodiment, the transmitted data include sequences of instantaneous pressure data, from which the computer compiles a database for each trash compactor. The computer determines fullness from the database. In other embodiments, the transmitted data include data relating to ram work, changes in pump motor current, or increases in container weight.

SUMMARY OF THE INVENTION

Broadly, this invention provides a unit for monitoring a trash compactor of a type comprising a container, a ram operative in compacting strokes for compacting trash in the container, and means for applying force to drive the ram. Broadly, the unit comprises means for sensing force applied to the ran during each compacting stroke and means for determining fullness of the container by generating a series of signals having values representative of the sensed force at successive times during such compacting stroke, determining which generated value is the maximum generated value, and comparing the maximum generated value to a threshold value indicative of fullness of the container. Preferably, the threshold value is user-definable from a remote computer. Herein, references to fullness are intended to refer to empty, partially full, and completely full conditions of the container.

Commonly, such a trash compactor comprises a container, a hydraulic ran operative in compacting strokes for compacting trash within the container, and a hydraulic pump operative for applying hydraulic pressure to advance and retract the ram during each compacting stroke of the trash compactor. The sensing means may be then arranged for sensing hydraulic pressure between the pump and the ram during each compacting stroke and for generating frequency signals representative of the sensed pressure. Moreover, the fullness-determining means may be then arranged for determining fullness of the container by generating a series of pressure signal values from the frequency signals, determining which generated pressure signal value is the maximum pressure signal value, and comparing the maximum pressure signals value to a threshold value. The generated pressure signal values are representative of the sensed pressure at successive times during such compacting stroke.

Thus, the fullness-determining means may be advantageously arranged for comparing the maximum pressure signal value to a minimum threshold value indicative that the trash compactor has a substantially empty container, determining that such compacting stroke occurred with the trash compactor having a substantially empty container if the maximum pressure signal value is less than the minimum threshold value in each of a specified number of successive instances with a delay time of a specified duration between the first and second instances, comparing the maximum pressure signal value to a maximum threshold value indicative of the trash compactor having a substantially full container if the maximum pressure signal value is not less than the minimum threshold value, and determining that such compacting stroke occurred with the trash compactor having a substantially full container if the maximum pressure signal value is compared to and exceeds the maximum threshold value.

Also, the fullness-determining means may be advantageously arranged for generating a status signal whenever a specified number of compacting strokes with the trash compactor having a substantially full container have been determined to have occurred, for generating a status signal whenever a specified number of compacting strokes with the trash compactor having a substantially empty container have been determined to have occurred, or for both functions. The unit may comprise means for transmitting the status signal or status signals to a computer at remote location when the status signal or status signals are generated.

This invention also provides a system comprising a plurality of the monitoring units noted above for monitoring a plurality of trash compactors of the type noted above from a central computer. Each monitoring unit is associated with a respective one of the trash compactors. Also, the system comprises means for sending the status signals to a central computer at a remote location.

These and other objects, features, and advantages of this invention are evident from the following description of a preferred embodiment of this invention with reference to the accompanying drawings.

DETAILED DESCRIPTION OF PREFERRED EMBODIMENT

Figure 1:
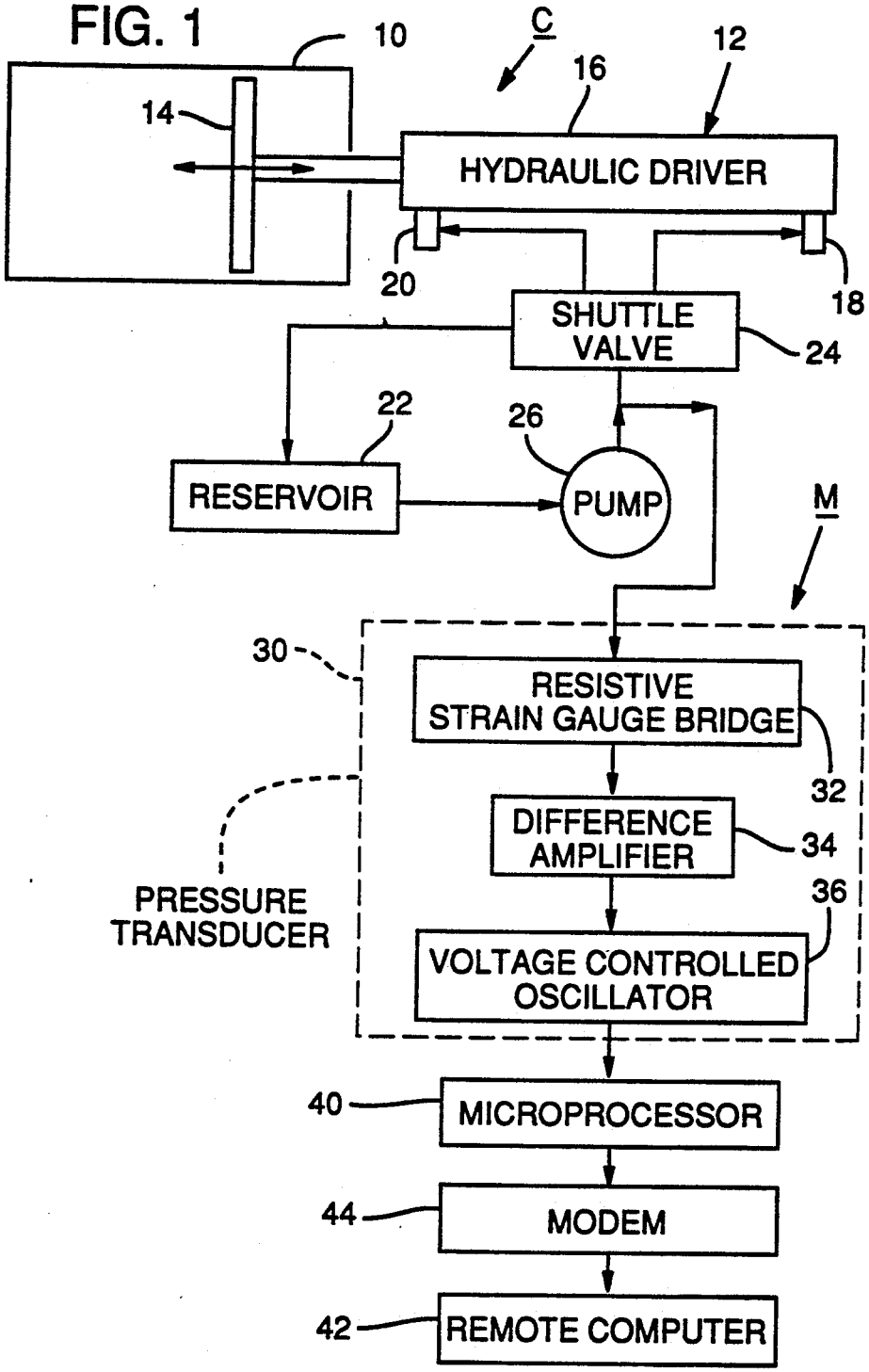
FIG. 1 is a schematic diagram of a trash compactor comprising a trash container, a hydraulic driver including a cylinder and a ram, a hydraulic pump, and related components, as associated with a monitoring unit according to this invention. The monitoring unit includes a pressure transducer, a microprocessor arranged to receive pressure signals from the transducer, and a modem, which is arranged to send status signals to a remote computer.

As shown diagrammatically in FIG. 1, a monitoring unit M according to this invention is combined with a trash compactor C of the type noted above. The trash compactor C comprises a trash container 10 and a hydraulic driver 12, which includes a ran 14 operative for compacting trash within the container 10, and which includes a hydraulic cylinder 16. The cylinder 16 is arranged to receive hydraulic fluid at a first connection 18 for advancing the ram 14 relative to the container 10 and to receive hydraulic fluid at a second connection 20 for retracting the ram 14 relative to the container 10.

The trash compactor 9 also comprises a reservoir 22 for hydraulic fluid, a shuttle valve 24, and a hydraulic pump 26. The shuttle valve 24 is operative selectively in a ram-advancing mode for directing hydraulic fluid from the pump 26 to the first connection 18 and for returning hydraulic fluid from the second connection 20 to the reservoir 22 and in a ram-retracting mode for directing hydraulic fluid from the pump 26 to the second connection 20 and for returning hydraulic fluid from the first connection 18 to the reservoir 22. The pump 26 is operative for receiving hydraulic fluid from the reservoir 22 and for directing hydraulic fluid to the shuttle valve 24 so as to apply hydraulic pressure to the ram 14, via the shuttle valve 24 and the cylinder 16. Thus, the pump 26 may be also considered as applying hydraulic force to the ram 14, via the shuttle valve 24 and the cylinder 16. The trash container 10, the hydraulic driver 12, the reservoir 22, the shuttle valve 24, the pump 26, and other components of the trash compactor C may be conventional components, details of which are outside the scope of this invention.

The monitoring unit N comprises a pressure transducer 30 arranged for sensing hydraulic pressure or hydraulic force, as applied by the pump 26 to the ran 12, via the shuttle valve 24 and the cylinder 16. The transducer 30 is connected to a hydraulic line between the pump 26 and the shuttle valve 24. The pressure transducer 30 is connected to the hydraulic line in a manner similar to the manner wherein pressure transducers are connected conventionally to hydraulic lines. Preferably, the pressure transducer 30 is a Model EAF Frequency Output Pressure Transducer available commercially from Data Instruments, Inc. of Acton, Mass.

The pressure transducer 30 comprises three principal components, namely a resistive strain gauge bridge 32 responsive to hydraulic pressure, a difference amplifier 34 responsive to the resistive strain gauge bridge 32, and a voltage controlled oscillator 36 responsive to the difference amplifier 34. The resistive strain gauge bridge 32 generates an analog signal proportional to the pressure sensed by the pressure transducer 30. The difference amplifier 34 amplifies the analog signal. The voltage controlled oscillator 36 converts the analog signal to a frequency signal. An analog signal corresponding to a sensed pressure having a value in a range from approximately zero psig to approximately 2000 psig is converted by the voltage controlled oscillator 36 to a frequency signal having a value in a range from approximately one KHz to approximately six KHz. The frequency signal value varies directly with the sensed pressure value.

The pressure transducer 30 supplies the frequency signal to a microprocessor 40. The microprocessor 40 is arranged to send signals to a remote computer 42, via a conventional modem 44 and telephone connections, in certain circumstances discussed below. Preferably, the microprocessor 40 is a Signetics Phillips Model SC80C451CCA68 microprocessor utilizing an instruction set similar to the instruction set of the Intel 8051 microprocessor and available commercially from numerous sources. The remote computer 42 may be an AT Type IBM-compatible personal computer using the MS-DOS operating system and having a 20 MEG (minimum) hard disk and a 3½" low density floppy drive. The modem 44 may be any suitable Hayes-compatible 1200 baud internal modem. Details of the remote computer 42 and the modem 44 are outside the scope of this invention. Telephone connections are made through standard, voice grade level lines, not through a switchboard and not through an extension.

Figure 2A:
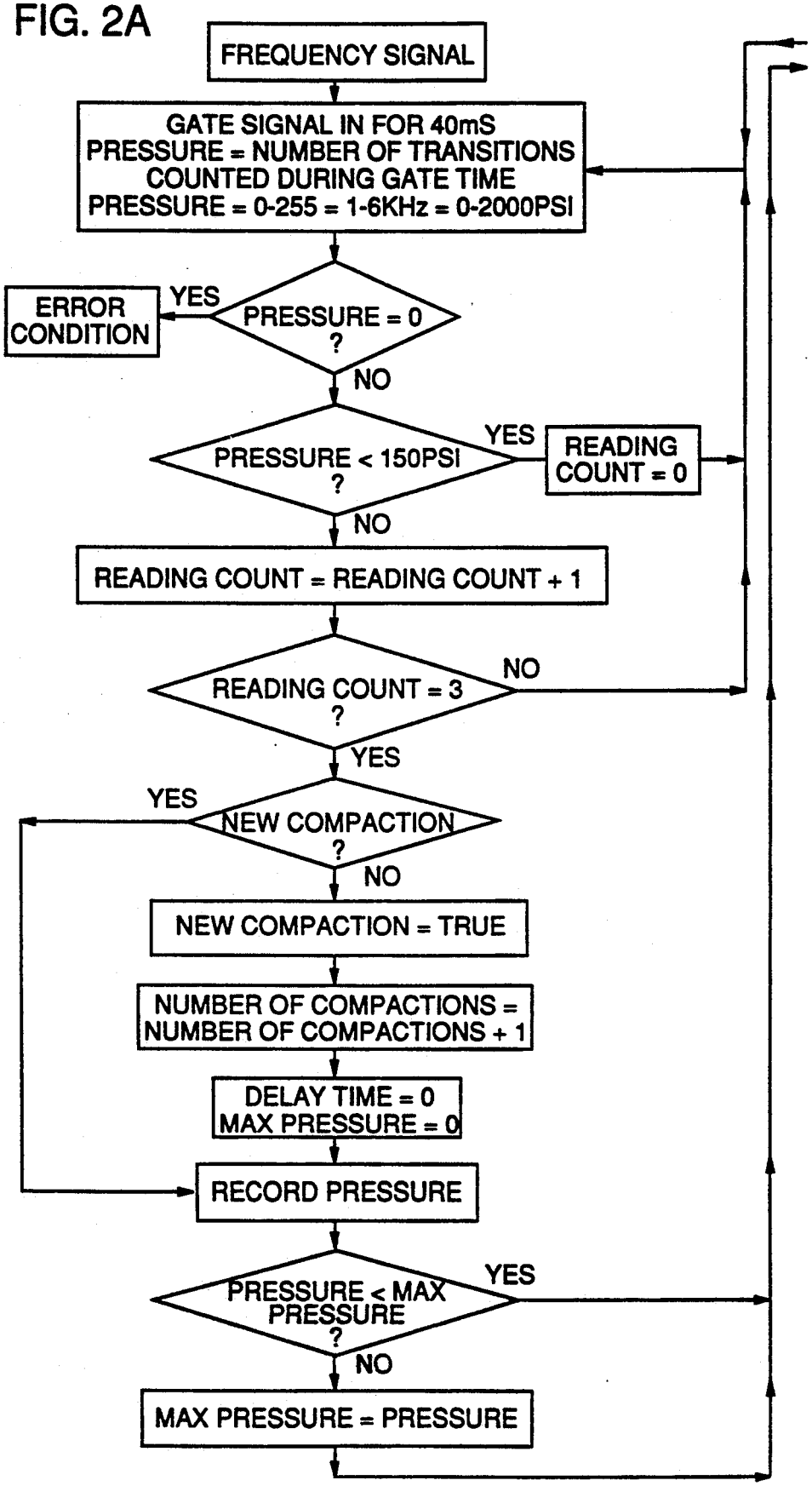
FIGS. 2A and 2B are respective sections of a logical diagram showing various processing steps performed by the microprocessor receiving pressure signals from the transducer. Exemplary values, from a preferred embodiment, are indicated on the logical diagram.
Figure 2B:
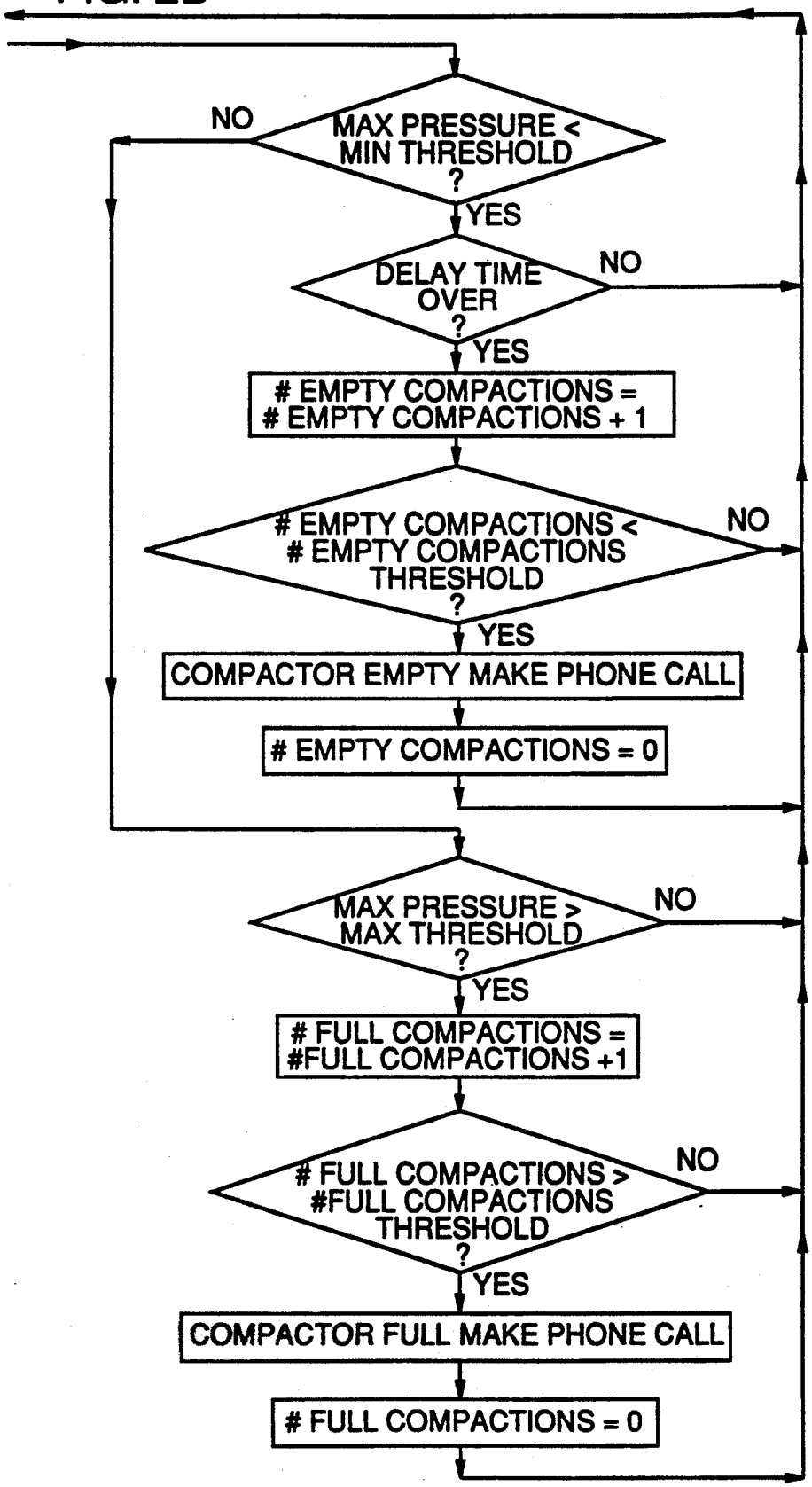

During each compacting stroke of the ram 14, the microprocessor 40 generates a series of gate signals, each having a fixed duration. In the preferred embodiment, as indicated on FIG. 2A, the fixed duration is 40 milliseconds. The microprocessor 40 counts all transitions in the frequency signal over the fixed duration of each gate signal. Generally, the transition count represents an average value for the sensed pressure, over the fixed duration of each gate signal. In the preferred embodiment, as indicated on FIG. 2A, transition counts ranging from zero to 255 are representative of frequencies ranging from one KHz to six KHz, which are representative of sensed pressures ranging of zero psig to 2000 psig. From the transition counts, the microprocessor 40 generates a series of signals having values representative of the sensed pressure at successive times during each compacting stroke.

Whenever such a signal is generated, the microprocessor 40 compares the value of the generated signal to a null pressure value, which represents zero psig. If the microprocessor 40 determines that the value of the generated signal equals the null pressure value, the microprocessor 40 determines that an error condition exists. Usually, such an error condition indicates that the pressure transducer 30 is not connected properly, or that it is disconnected. The microprocessor 40 may be optionally programmed to send an error signal to the remote computer 42, via the modem 44 and telephone connections, whenever the microprocessor 40 determines that such an error condition exists.

If the microprocessor 40 determines that the value of the generated signal exceeds the null pressure value, the microprocessor 40 compares the value of the generated signal to a reference pressure value, which represents 150 psig in the preferred embodiment. The reference pressure value is intended to represent the minimum pressure required to advance the ram 14. The microprocessor 40 takes no action if it determines that the value of the generated signal is less than the reference pressure value. If the microprocessor 40 determines that the value of the generated signal is not less than the reference pressure value, the microprocessor 40 increments a reading count by one.

The microprocessor 40 compares the reading count to a specified number. The specified number is a whole, nonzero number, preferably plural, which is defined by a user entering parameters into the microprocessor 40. The specified number is three in the preferred embodiment. The microprocessor 40 takes no action if it determines that the reading count is less than the specified number.

If the microprocessor 40 determines that the reading count equals the specified number, the microprocessor 40 determines that a new compacting stroke is occurring and increments a compaction count by one. Also, the microprocessor 40 records the value of the generated signal and resets the reading count to zero. Also, the microprocessor 40 resets a delay time counter noted below to zero and rests a maximum pressure value noted below to a null value, which represents zero psig.

Since a single value may represent an abnormal condition, it is preferred for the specified number to be a plural number, whereby a determination by the microprocessor 40 that a compacting stroke is occurring tends to be more reliable than the determination would be if the specified number were one.

The microprocessor 40 compares the recorded value of the generated signal to the maximum pressure value. If it is less than the maximum pressure value, the recorded value of the generated signal is ignored. If it is not less than the maximum pressure value, the recorded value of the generated signal is recorded as the maximum pressure value, in place of the maximum pressure value set initially or recorded previously.

Although the hydraulic pressure applied to the ram 14 tends to increase as the ram 14 advances, such pressure can fluctuate, particularly but not exclusively because the advancing ram 14 tends to smash wooden crates and other frangible trash. Also, when the ram 14 begins to retract, the hydraulic pressure applied thereto tends to drop markedly. However, the microprocessor 40 determines the maximum pressure value from the series of generated pressure values without regard to the position of the ram 14, and without regard to any decreases in the hydraulic pressure applied to the ram 14 as the ran advances and retracts.

The microprocessor 40 compares the maximum pressure value to a minimum threshold pressure value. As defined by a user entering parameters into the microprocessor 40, the minimum threshold is a relatively low pressure value, 500 psig as an example, below which the container 10 of the trash compactor C is considered to be substantially empty.

If the microprocessor 40 determines that the maximum pressure value is less than the minimum threshold pressure, the microprocessor 40 determines whether the time delay defined by the time delay counter is over and takes no action if it determines that the time delay is not over. Effectively, the microprocessor 40 takes no action unless it determines that the maximum pressure value is less than the minimum threshold pressure, in each of a specified number of successive instances with a time delay of a specified duration between the first and second instances. The time delay is a short delay, three seconds as an example, which is defined by a user entering parameters into the microprocessor 40. The time delay is intended to avert a false determination by the microprocessor 40 that an empty compaction has occurred from the hydraulic pressure that is sensed just as the ram 14 begins to advance.

If the microprocessor 40 determines that the time delay is over after determining that the maximum pressure value is less than the minimum threshold pressure, the microprocessor 40 increments an empty compaction count by one. Whenever the empty compaction count is incremented, the microprocessor 40 compares the empty compaction count to an empty compaction threshold number, which is defined by a user entering parameters into the microprocessor 40. Preferably, the empty compaction threshold number is a plural number, two as an example. If the microprocessor 40 determines that the empty compaction count is less than the empty compaction threshold number, the microprocessor 40 takes no action, except that the microprocessor 40 resets the time delay.

If the microprocessor 40 determines that the empty compaction count equals the empty compaction threshold number, the microprocessor 40 determines and generates a status signal indicating that the container of the trash compactor is substantially empty. Also, the microprocessor 40 transmits the status signal to the remote computer 42, via the modem 44 and telephone connections.

Since a single value may represent an abnormal condition, it is preferred for the empty compaction threshold number to be a plural number, whereby a determination by the microprocessor 40 that the container of the trash compactor is substantially empty tends to be more reliable than the determination would be if the empty compaction threshold number were one.

If the microprocessor 40 determines that the maximum pressure value is not less than the minimum threshold pressure value, the microprocessor 40 compares the maximum pressure value to a maximum threshold pressure value. The microprocessor 40 takes no action if it determines that the maximum pressure value is not more than the maximum threshold pressure value. As defined by a user entering parameters into the microprocessor 40, the maximum threshold is a relatively high pressure value, 1000 psig as an example, above which the container 10 of the trash compactor C is considered to be substantially full.

If the microprocessor 40 determines that the maximum pressure value is more than the maximum threshold pressure value, the microprocessor 40 increments a full compaction count by one. After the full compaction count has been incremented, the microprocessor 40 compares the full compaction count to a full compaction threshold number, which is defined by a user entering parameters into the microprocessor 40. The full compaction threshold number is a counting number, preferably plural, three as an example. The microprocessor 40 takes no action if it determines that the full compaction count is less than the full compaction threshold number.

If the microprocessor 40 determines that the full compaction count equals the full compaction threshold number, the microprocessor 40 determines and generates a status signal indicating that the container of the trash compactor is substantially full and transmits the status signal to the remote computer 42, via the modem 44 and telephone connections.

Since a single value may represent an abnormal condition, it is preferred for the full compaction threshold number to be a plural number, whereby a determination by the microprocessor 40 that the container of the trash compactor is substantially full tends to be more reliable than the determination would be if the full compaction threshold number were one.

A user enters certain parameters noted above into the microprocessor 40, from the remote computer 42, namely the reference pressure value, the minimum threshold pressure value, the duration of the time delay, the empty compaction threshold number, the maximum threshold pressure value, and the full compaction threshold number. It may be then necessary for the user to enter, for each microprocessor 40, different parameters appropriate for the trash compactor C associated with such microprocessor 40. When the microprocessor 40 is initialized, the maximum pressure value recorded by the microprocessor 40 is set initially to a null value, and the reading, compaction, empty compaction, and full compaction counts are set initially to zero.

The microprocessor 40 is programmed to perform its various functions noted above. Moreover, the microprocessor 40 and the computer 42 may be also programmed to enable the computer 42 to poll the microprocessor 42 at any time for data, such as the maximum pressure value and the compaction count.

Figure 3:
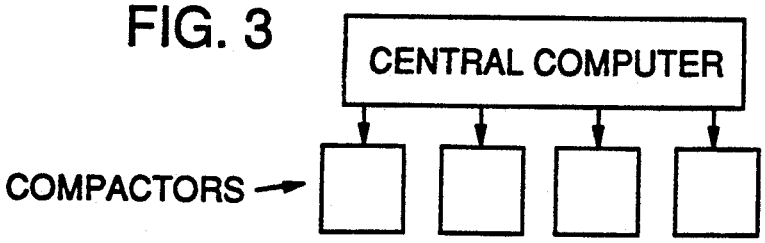
FIG. 3 is a schematic diagram of a system including a plurality of monitoring units similar to the monitoring unit of FIG. 1 for monitoring a plurality of trash compactors similar to the trash compactor of FIG. 1 from a remote, central computer arranged to receive status signals from the microprocessors of such units, via the modems of such units.

As shown in FIG. 3, such a computer 42 may be advantageously used as a remote, central computer in a system for monitoring a plurality of such trash compactors C, each being associated with such a monitoring unit M comprising such a pressure transducer 30, such a microprocessor 40, and such a modem 44, as described above.

Various modifications may be made in the preferred embodiment described above without departing from the scope and spirit of this invention.

I claim:

1. A unit for monitoring a trash compactor of a type comprising a container, a ram operative in compacting strokes for compacting trash within the container, and means for applying force to drive the ram, the unit comprising (a) means for sensing force applied to the ram at successive times during each compacting stroke and (b) means for determining fullness of the container of the trash compactor by (1) generating a series of signals having values representative of the sensed force at successive times during such compacting stroke, (2) determining which generated signal value is the maximum generated value, and (3) comparing the maximum generated signal value to a threshold value indicative of fullness of the container of the trash compactor.

2. The unit of claim 1 wherein the threshold value is user-definable from a remote computer.

3. A unit for monitoring a trash compactor of a type comprising a container, a hydraulic ram operative in compacting strokes for compacting trash within the container, and a hydraulic pump operative for applying hydraulic pressure to the ram to advance and retract the ram during each compacting stroke, the unit comprising (a) means for sensing hydraulic pressure applied by the pump to the ram at successive times during each compacting stroke and for generating frequency signals representative of the sensed pressure and (b) means for determining fullness of the container of the trash compactor by (1) generating a series of pressure signal values from the frequency signals, the values being representative of the sensed pressure at successive times during such compacting stroke, (2) determining which generated pressure signal value is the maximum pressure signal value, (3) comparing the maximum pressure signal value to a threshold value indicative of the trash compactor having a container with a specified degree of fullness, and (4) determining that such compacting stroke occurred with the trash compactor having a container with the specified degree of fullness if the maximum pressure signal value exceeds the threshold value indicative thereof.

4. The unit of claim 3 wherein the threshold value is user-definable from a remote computer.

5. The unit of claim 4 wherein the fullness-determining means is arranged for generating a status signal whenever a specified, plural number of compacting strokes with the trash compactor having a container with the specified degree of fullness have been determined to have occurred.

6. A unit for monitoring a trash compactor of a type comprising a container, a hydraulic ram operative in compacting strokes for compacting trash within the container, and a hydraulic pump operative for applying hydraulic pressure to the ram to advance and retract the ram during each compacting stroke, the unit comprising (a) means for sensing hydraulic pressure applied by the pump to the ram at successive times during each compacting stroke and (b) means for determining fullness of the container of the trash compactor by (1) generating a series of pressure signals having values representative of the sensed pressure at successive times during such compacting stroke, (2) determining which generated pressure signal value is the maximum pressure signal value, (3) comparing the maximum pressure signal value to a minimum threshold value indicative of the trash compactor having a substantially empty container, (4) determining that such compacting stroke occurred with the trash compactor having a substantially empty container, if the maximum pressure signal value is less than the minimum threshold value in each of a specified number of successive instances with a delay time of a specified duration between the first and second instances, (5) comparing the maximum pressure signal value to a maximum threshold value indicative of the trash compactor having a substantially full container, if the maximum pressure signal value is not less than the minimum threshold value, and (6) determining that such compacting stroke occurred with the trash compactor having a substantially full container if the maximum pressure signal value is compared to and exceeds the maximum threshold value.

7. The unit of claim 6 wherein the fullness-determining means is arranged for generating a status signal whenever a specified, plural number of compacting strokes with the trash compactor having a substantially full container have been determined to have occurred.

8. The unit of claim 7 further comprising means for transmitting the status signal to a computer at a remote location when the status signal is generated.

9. The unit of claim 6 wherein the fullness-determining means is arranged for generating a status signal whenever a specified, plural number of compacting strokes with the trash compactor having a substantially empty container have been determined to have occurred.

10. The unit of claim 9 further comprising means for transmitting the status signal to a computer at a remote location when the status signal is generated.

11. The unit of claim 6 wherein the fullness-determining means is arranged for generating a status signal whenever a specified, plural number of compacting strokes with the trash compactor having a substantially full container have been determined to have occurred and for generating a status signal whenever a specified, plural number of compacting strokes with the trash compactor having a substantially empty container have been determined to have occurred, whichever may have been determined.

12. The unit of claim 11 further comprising means for transmitting the status signals to a computer at a remote location when the status signals are generated.

13. The unit of claim 6 wherein the minimum and maximum threshold values are user-definable from a remote computer.

14. A system for monitoring a plurality of trash compactors from a central computer at a remote location, each trash compactor comprising a container, a hydraulic ram operative in compacting strokes for compacting trash within the container, and a hydraulic pump operative for applying hydraulic pressure to the ran to advance and retract the ram during each compacting stroke, the system comprising a plurality of monitoring units, each monitoring unit being associated with a respective one of the trash compactors, each monitoring unit comprising (a) means for sensing hydraulic pressure applied by the pump to the ram during each compacting stroke and (b) means for determining fullness of the container of the trash compactor associated therewith by (1) generating a series of pressure signals having values representative of the sensed pressure at successive times during such compacting stroke, (2) determining which generated pressure signal value is the maximum pressure signal value, (3) comparing the maximum pressure signal value to a maximum threshold value, (4) determining that such compacting stroke occurred with the trash compactor having a substantially full container if the maximum pressure signal value is compared to and exceeds the maximum threshold value, (5) generating a status signal whenever a specified, plural number of compacting strokes with the trash compactor associated therewith having a substantially full container have been determined to have occurred, and (c) means for transmitting the status signal to a central computer at a remote location when the status signal is generated.

15. A system for monitoring a plurality of trash compactors from a central computer at a remote location, each trash compactor comprising a container, a hydraulic ram operative for compacting trash within the container, and a hydraulic pump operative for applying hydraulic pressure to the ran to advance and retract the ram during each compacting stroke, the system comprising a plurality of monitoring units, each monitoring unit being associated with a respective one of the trash compactors, each monitoring unit comprising (a) means for sensing hydraulic pressure applied by the pump to the ram during each compacting stroke in the trash compactor associated therewith and (b) means for determining fullness of the container of the trash compactor associated therewith by (1) generating a series of pressure signal values representative of the sensed pressure at successive times during such compacting stroke, (2) determining which generated pressure signal value is the maximum pressure signal value, (3) comparing the maximum pressure signal value to a minimum threshold value indicative of the trash compactor associated therewith having a substantially empty container, (4) determining that such compacting stroke occurred with the trash compactor associated therewith having a substantially empty container if the maximum pressure signal value is less than the minimum threshold value, (5) comparing the maximum pressure signal value to a maximum threshold value indicative of the trash compactor associated therewith having a substantially full container if the maximum pressure signal value is not less than the minimum threshold value, and (6) determining that such compacting stroke occurred with the trash compactor associated therewith having a substantially full container if the maximum pressure signal value is compared to and exceeds the maximum threshold value, (7) generating a status signal whenever a specified, plural number of compacting strokes with the trash compactor associated therewith having a substantially empty container has been determined to have occurred, and (8) generating a status signal whenever a specified, plural number of compacting strokes with the trash compactor associated therewith having a substantially full container has been determined to have occurred, and (c) means for transmitting the status signals to a central computer at a remote location when the status signals are generated.

* * * * *

UNITED STATES PATENT AND TRADEMARK OFFICE

CERTIFICATE OF CORRECTION

PATENT NO. : 5,299,493

DATED : April 5, 1994

INVENTOR(S) : Martin J. Durbin and Morris Simon

It is certified that error appears in the above-identified patent and that said Letters Patent is hereby corrected as shown below:

Column 2, line 4, "Neur Aann should be --Neumann--.

Column 2, line 53, "signals" should be --signal--.

Column 4, line 1, "9" should be --C--.

Column 4, line 22, "N" should be --M--.

Column 4, line 24, "ran" should be --ram--.

Column 10, line 6, "ran" should be --ram--.

Column 10, line 42, "ran" should be --ram--.

Signed and Sealed this

Nineteenth Day of July, 1994

Bruce Lehman

*Attest:*

BRUCE LEHMAN

*Attesting Officer*

*Commissioner of Patents and Trademarks*